US010723144B2

(12) United States Patent
Kopp et al.

(10) Patent No.: US 10,723,144 B2
(45) Date of Patent: Jul. 28, 2020

(54) METHOD AND FIXER FOR FIXING OF PRINT IMAGES ON A RECORDING MEDIUM

(71) Applicant: Océ Holding B.V., Venlo (NL)

(72) Inventors: Christian Kopp, Planegg (DE); Georg Landmesser, Haar (DE); Bernhard Hochwind, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/249,125

(22) Filed: Jan. 16, 2019

(65) Prior Publication Data

US 2019/0217634 A1 Jul. 18, 2019

(30) Foreign Application Priority Data

Jan. 16, 2018 (DE) ..... 10 2018 100 815

(51) Int. Cl.
*B41J 11/00* (2006.01)
*B41J 2/21* (2006.01)

(52) U.S. Cl.
CPC ..... *B41J 11/002* (2013.01); *B41J 2/21* (2013.01); *B41J 2/2146* (2013.01); *B41J 11/0095* (2013.01)

(58) Field of Classification Search
CPC ..... B41J 11/002; B41J 11/0095
See application file for complete search history.

(56) References Cited

U.S. PATENT DOCUMENTS 5,502,475 A 3/1996 Kaburagi et al.
6,511,147 B2 * 1/2003 Kubota ..... B41J 11/002 347/102
2002/0164958 A1 * 11/2002 Slaughter ..... H01Q 1/125 455/73
2003/0020795 A1 * 1/2003 Br ..... B41J 11/002 347/102
2003/0164958 A1 * 9/2003 Shima ..... B41J 11/002 358/1.7

FOREIGN PATENT DOCUMENTS

DE 0000068927528 T2 4/1997
DE 19835046 B4 1/2008

OTHER PUBLICATIONS

Foreign action dated Sep. 20, 2018 Application No. 10 2018 100 815.5.

* cited by examiner

*Primary Examiner* — Sharon A. Polk
(74) *Attorney, Agent, or Firm* — Schiff Hardin LLP

(57) ABSTRACT

In a method for fixing a print image on a recording medium, data is determined for controlling one or more radiation sources to fix the print image. The data can be determined based on a deformation model of the recording medium such that a deformation of the recording medium is reduced or minimized.

12 Claims, 3 Drawing Sheets

METHOD AND FIXER FOR FIXING OF PRINT IMAGES ON A RECORDING MEDIUM

CROSS REFERENCE TO RELATED APPLICATIONS

This patent application claims priority to German Patent Application No. 102018100815.5, filed Jan. 16, 2018, which is incorporated herein by reference in its entirety.

BACKGROUND

In a printing device, in particular in an inkjet-based and/or toner-based printing device, ink-based or toner-based print images are applied onto a recording medium and are subsequently fixed onto said recording medium. The fixing of a print image may thereby take place in an energy-efficient manner via a point-shaped infrared beam, for example as in DE 198 35 046 B4. DE 689 27 528 T2 describes a colored beam recording device with fixer arrangement.

The fixing of a print image may lead to alterations of properties of the recording medium, which in duplex printing in particular may lead to negative effects on the print quality and/or on the printing device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4A:
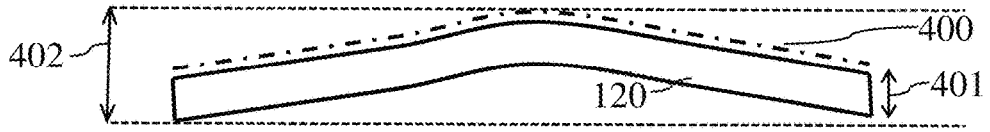
Figure 4B:
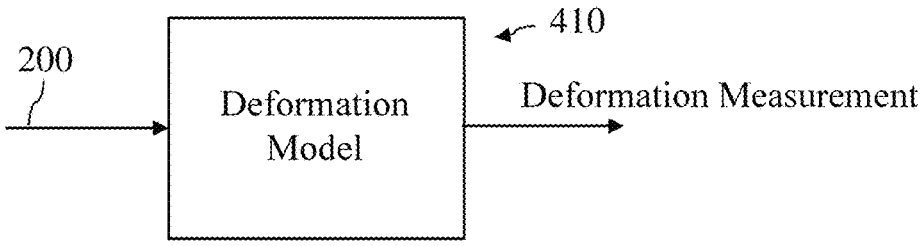
Figure 4C:
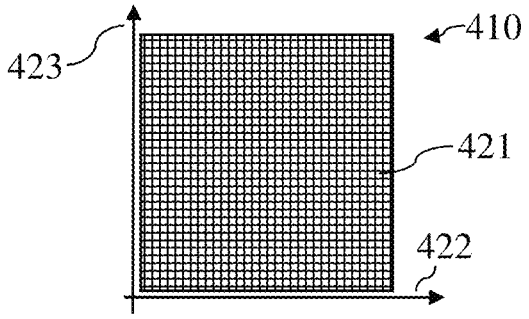
Figure 5:
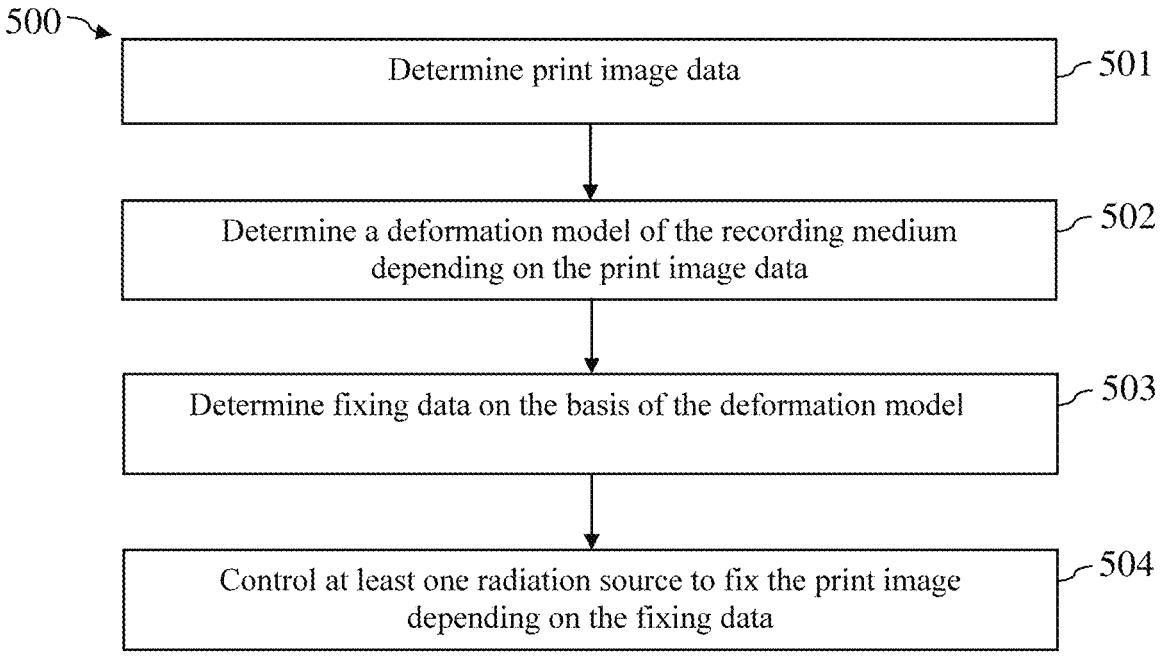

FIG. 4*a* illustrates an example of a deformed recording medium;

FIG. 4*b* illustrates a deformation model for a recording medium according to an exemplary embodiment of the present disclosure;

FIG. 4*c* illustrates a finite element-based deformation model according to an exemplary embodiment of the present disclosure; and FIG. 5 illustrates a workflow diagram of a method for fixing of a print image on a recording medium according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

The present document deals with the technical object of providing a method and a fixer to fix a print image, via which method and fixer the negative effects on the print quality and/or on the printer may be reduced, in particular given duplex printing.

According to an aspect of the disclosure, a method is described for fixing a print image onto a recording medium. In an exemplary embodiment, the method includes the determination of print image data with regard to the print image that has been or is printed onto a surface of the recording medium. In an exemplary embodiment, the method also includes the determination, based on the print image data, of a deformation model for the recording medium. The deformation model thereby indicates how the recording medium that is printed to with the print image is deformed (in total or further) due to the action of radiation to fix the print image. In particular, the deformation model may indicate how different radiation (for example radiation with different spectra, frequencies, and/or intensity) respectively affects the (total) deformation of the recording medium. In other words, the deformation model may indicate a (total) deformation or warping of the recording medium that is printed to with the print image, after the effect of radiation to fix the print image. Furthermore, the method includes the determination, based on the deformation model, of fixer data for controlling one or more radiation sources that are configured to generate radiation to fix the print image. In an exemplary embodiment, the fixer data is determined such that (based on the deformation model) the deformation of the recording medium that is printed to with the print image is reduced, in particular is minimized. Moreover, in an exemplary embodiment, the method includes the operation of the one or more radiation sources depending on the fixer data in order to fix the print image at least partially on the recording medium. Negative effects on the print quality and/or on a printer may thus be reduced, in particular given duplex printing.

According to an aspect of the disclosure, a fixer for fixing of a print image on a recording medium is described. In an exemplary embodiment, the fixer comprises one or more radiation sources that are configured to generate radiation to fix the print image. Furthermore, in an exemplary embodiment, the fixer comprises a controller that is configured to determine print image data with regard to the print image that has been or is printed onto a surface of the recording medium. In an exemplary embodiment, the controller is also configured to determine a deformation model for the recording medium on the basis of the print image data, wherein the deformation model indicates how the recording medium that is printed to with the print image is deformed or warped (overall or further) due to the effect of radiation for fixing of the print image. In particular, in an exemplary embodiment, the deformation model may indicate what total deformation or total warping of the recording medium is produced due to the application of the print image and due to the subsequent fixing of the print image. The deformation model may indicate the total deformation or total warping of the recording medium as a function of the fixer data. Moreover, the controller is configured to determine, on the basis of the deformation model, fixer data for the control of the one or more radiation sources. Furthermore, in an exemplary embodiment, the fixer is configured to operate the one or more radiation sources depending on the fixer data in order to at least partially fix the print image on the recording medium.

Figure 1:
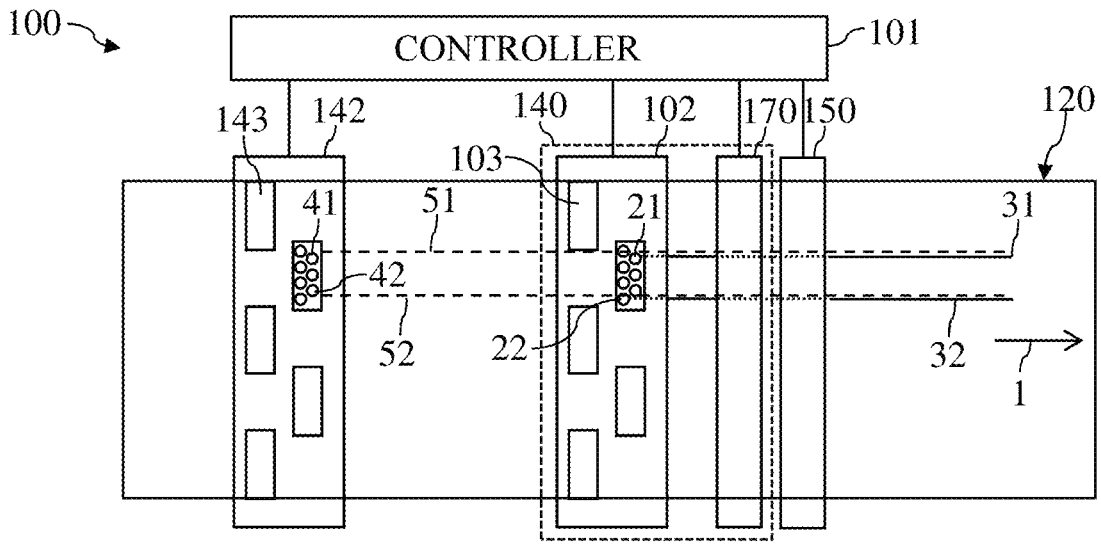
FIG. 1 illustrates a block diagram of an inkjet printer according to an exemplary embodiment of the present disclosure.

The printer 100 depicted in FIG. 1 is designed for printing to a recording medium 120 in the form of a web (also referred to as a "continuous feed," since the recording medium 120 is supplied continuously, for example from a roll, to the printer 100). The recording medium 120 may be produced from paper, paperboard, cardboard, metal, plastic, textiles, a combination thereof, and/or other materials that are suitable and can be printed to. The recording medium 120 is typically taken off a roll (the takeoff) and then supplied to the print group 140 of the printer 100. A print image is applied onto the recording medium 120 by the print group 140, and the recording medium 120 that has been printed to is taken up again (possibly after fixing/drying of the print image) onto an additional roll (the takeup). Alternatively, the recording medium 120 that has been printed to may be cut into sheets or single pages by a cutting device. In FIG. 1, the transport direction of the recording medium 120 is represented by an arrow 1. The statements in this document are also applicable to a printer 100 for printing to recording media 120 in the form of sheets or pages or plates. Alternatively or additionally, the statements in this document are also applicable a liquid toner-based or dry toner-based printer 100.

In an exemplary embodiment, the print group 140 of the printer 100 comprises a print bar 102 that may be used for printing with ink of a defined color (for example black, cyan, magenta and/or yellow, and possibly Magnetic Ink Character Recognition (MICR) ink). A print group 140 may comprise a plurality of print bars 102 for printing with respective different inks. Furthermore, the print group 140 may comprise at least one fixer 170 that is configured to fix a print image printed onto the recording medium 120. If applicable, a fixer 170 may be arranged after each print bar 102 in order to at least partially fix the print image applied by the respective print bar 102.

A print bar 102 may comprise one or more print heads 103 that are possibly arranged side by side in multiple rows in order to print the dots of different columns 31, 32 of a print image onto the recording medium 120. In the example depicted in FIG. 1, a print bar 102 comprises five print heads 103, wherein each print head 103 prints the dots of one group of columns 31, 32 of a print image onto the recording medium 120.

In the embodiment illustrated in FIG. 1, each print head 103 of the print group 140 comprises a plurality of nozzles 21, 22, wherein each nozzle 21, 22 is configured to fire or push ink droplets onto the recording medium 120. For example, a print head 103 may comprise multiple thousands of effectively utilized nozzles 21, 22 that are arranged along one or more rows transversal to the transport direction 1 of the recording medium 120. The nozzles 21, 22 in the individual rows may be arranged offset from one another. Dots of a line of a print image may be printed on the recording medium 120, transversal to the transport direction 1 (meaning along the width of the recording medium 120), by means of the nozzles 21, 22 of a print head 103 of the print group 140.

In an exemplary embodiment, printer 100 also comprises a controller 101 (for example an activation hardware, one or more processors, and/or one or more circuits) that is configured to activate the actuators of the individual nozzles 21, 22 of the individual print heads 103 of the print group 140 in order to apply the print image onto the recording medium 120, depending on print data. The controller 101 may also be configured to activate other components of the printer 100, for example a coater 142 and/or a sensor and/or the fixer 170. In an exemplary embodiment, the controller 101 includes processor circuitry that is configured to: activate the actuators based on the print data; and/or activate or otherwise control one or more components of the printer 100.

The print group 140 of the printer 100 thus comprises at least one print bar 102 having K nozzles 21, 22 that may be activated with a line signal, depending on the transport velocity and the print resolution, in order to print a line (transversal to the transport direction 1 of the recording medium 120) with K pixels or K columns 31, 32 of a print image onto the recording medium 120. The nozzles 21, 22 may be distributed among one or more print heads 103. In the presented example, the one or more print heads 103 are installed immobile or fixed in the printer 100, and the recording medium 120 is directed past the stationary nozzles 21, 22 at a defined transport velocity. Alternatively or additionally, the one or more print heads 103 may be moved across the recording medium 120 (for example transversal to the transport direction 1 of the recording medium 120).

In an exemplary embodiment, the printer 100 comprises a coater 142 that is designed corresponding to a print bar 102 for ink. In particular, a print bar 102 having one or more print heads 103 may be used as a coater 142. In the example depicted in FIG. 1, the coater 142 comprises a plurality of coating substance print heads 143 arranged offset to one another, respectively having one or more coating substance nozzles 41, 42. The above statements regarding a print bar 102, a print head 103, and a nozzle 21, 22 may be correspondingly applied to the coater 142, a coating substance print head 143, and a coating substance nozzle 41, 42.

In an exemplary embodiment, each coating substance nozzle 41, 42 is configured to fire droplets of coating substance onto the recording medium 120. A coating image made of coating substance may thus be printed onto the recording medium 120. If applicable, precisely one corresponding column 51, 52 of the coating image may thereby be applied onto the recording medium 120 by each coating substance nozzle 41, 42. Via a coating substance, in particular a primer, it may be produced that a "merging" of different inks, for example different inks from different print bars 102, may be reduced.

Moreover, the printer 100 may comprise a sensor 150 that is configured to detect sensor data with regard to a print image printed by the printer 100. For example, the sensor may comprise an image camera with which image data with regard to the print image may be optically detected. The sensor data may, for example, indicate a deformation of the recording medium 120 at the output of the print group 140 (for example a deformation orthogonal to the surface of the recording medium 120).

Figure 3:
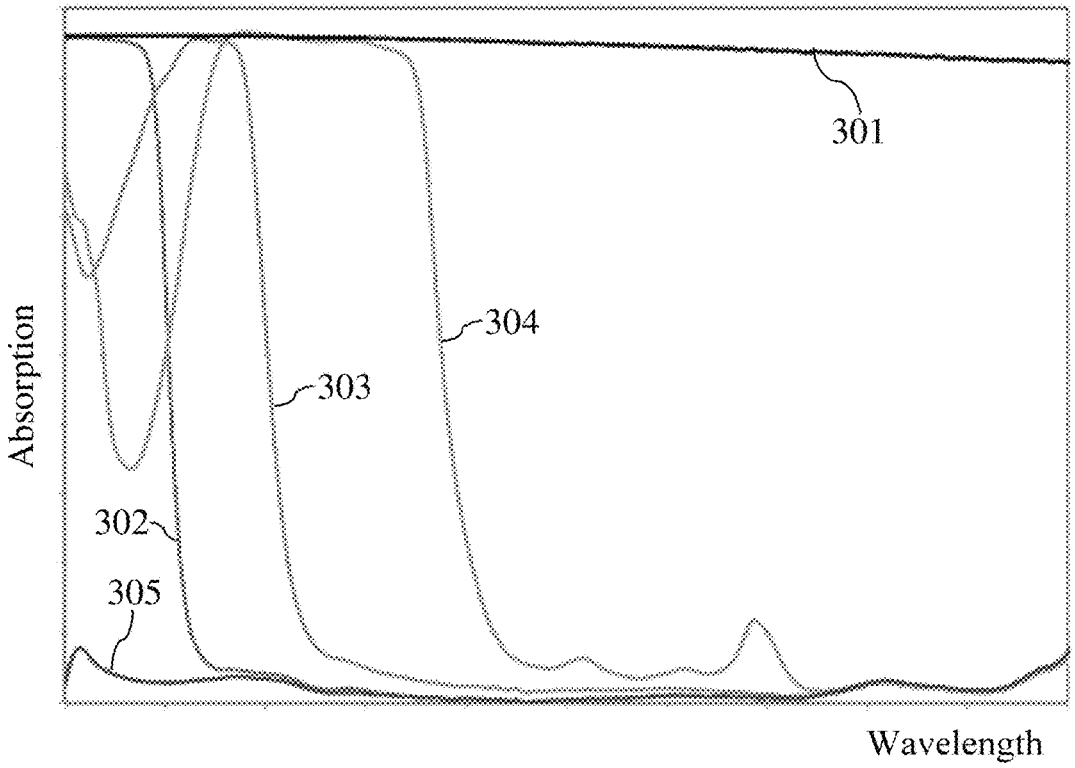
FIG. 3 illustrates absorption spectra for different color components of a print image and for a recording medium according to exemplary embodiments of the present disclosure.

In an exemplary embodiment, a radiation source is used to fix a print image. Given multicolor print images, the materializing fixing temperature—and therefore the resulting fixing quality—are thereby typically color-dependent. The color dependency is thereby based on the different absorption response of the color pigments or colorants or color components that are used, in the spectral range of the radiation source that is used. FIG. 3 shows examples of absorption spectra 301, 302, 303, 304 for different colors, in particular "black", "yellow", "magenta", and "cyan". Furthermore, FIG. 3 shows an example of an absorption spectrum 305 of a recording medium 120. As is illustrated in FIG. 3, the colors "yellow", "magenta", and "cyan" exhibit only relatively limited ranges with an absorption of up to 95%. The color "black" exhibits an absorption that is nearly invariably high (for example at 95% or more) in a wide wavelength range. On the other hand, the (typically white) recording medium 120 exhibits a relatively low degree of absorption (represented by the absorption spectrum 305).

Upon exposure of the print image with radiation of a single wavelength and a constant intensity over the surface of the print image, the different absorption response of the different colors leads to different temperatures in the regions of the print image that are printed with various colors. These temperature differences may moreover be influenced by the different quantities of fluid that need to evaporate for the different color components (in particular for the different inks) within the scope of the fixing. The resulting temperature differences between the different printed and unprinted regions of the recording medium 120 may lead to deformations of the recording medium 120. In particular, the recording medium 120 may become rippled due to temperature and/or moisture differences.

In a duplex printer 100, a first print image is typically printed onto the front side of a recording medium 120 in a first step and is subsequently (at least partially) fixed. In a second step, a second print image is thereupon printed onto the back side of the recording medium 120 and (at least partially fixed). Deformations of the recording medium 120 as a result of the first step typically lead to a negative effect on the print quality upon printing to the back side of the recording medium 120. Furthermore, a deformed recording medium 120, in particular a rippled recording medium 120, may produce damage (via contact) to a print group 140, in particular to a print head 103, of the printer 100.

Figure 2:
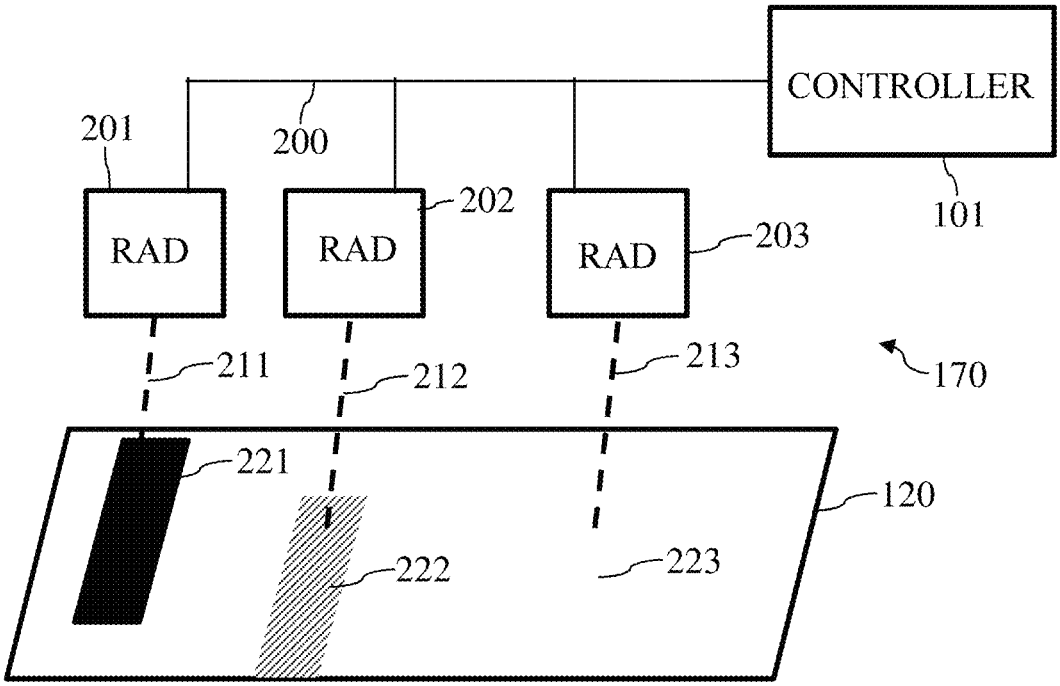
FIG. 2 illustrates a fixer according to an exemplary embodiment of the present disclosure that includes multiple radiation sources.

FIG. 2 shows a fixer 170 according to an exemplary embodiment having a plurality of radiation sources 201, 202, 203 that are configured to generate radiation 211, 212, 213 with different spectra or wavelengths, and to direct said radiation 211, 212, 213 onto the recording medium 120. In an exemplary embodiment, the radiation sources 201, 202, 203 are configured to selectively expose partial regions 221, 222, 223 of the recording medium 120, for example to expose individual dots of a print image on the recording medium 120. For example, a first partial region 221 of a print image may be exposed with the first radiation source 201, wherein the first partial region 221 may be printed with a first color component. Furthermore, if applicable a second partial region 222 of the print image may be exposed with the second radiation source 202, wherein the second partial region 222 has been printed with a second color component. Moreover, a third radiation source 203 may be provided, for example with which unprinted partial regions 223 of the recording medium 120 may be exposed. In an exemplary embodiment, the spectrum of a radiation source 201, 202, 203 are thereby adapted to the absorption spectrum 301, 302, 303, 304, 305 of the respective partial region 221, 222, 223. The different radiation sources 201, 202, 203 may thus be used to provide energy in a region-selective or dot-selective manner for fixing of a print image and/or for tempering of a recording medium 120.

In an exemplary embodiment, a radiation fixing of recording media 120 printed to in multiple colors in digital printing (for example ink printing or toner printing) is performed by the fixer 170 shown in FIG. 2. The spatially dependent color and applied quantity of fluid of the print image may thereby be taken into account in the fixing to control the radiation 211, 212, 213 that is radiated in a spatially dependent manner. In particular, one or more wavelengths and intensities of the radiation 211, 212, 213 may be adapted in a region-selective or dot-selective manner for fixing.

A print image-dependent exposure may thus be used for fixing. The exposure may have one or more wavelengths. The exposure may take place simultaneously or serially for different color components. The exposure with different radiation 211, 212, 213 may take place with the same or different intensities. It is possible that only printed regions 221, 222 may thereby be exposed. On the other hand, printed and unprinted regions 221, 222, 223 of a recording medium 120 may possibly be exposed.

In an exemplary embodiment, one or more criteria are taken into account to control or set the wavelength and/or the intensity of the radiation 211, 212, 213 that is conveyed for fixing. The radiation 211, 212, 213 may thereby be adapted depending on the print image, for example per dot. In an exemplary embodiment, the criteria are (alone or in combination):

- The radiation 211, 212, 213 may be generated such that the energy input in a print image layer is maximized, and such that the energy input into the recording medium 120 is minimized.
- The radiation 211, 212, 213 may be generated such that the temperature difference due to the energy input of the radiation 211, 212, 213 is minimized between different printed and possibly unprinted regions 221, 222, 223.
- The radiation 211, 212, 213 may be generated such that the moisture difference due to the energy input of the radiation 211, 212, 213 is minimized between different printed and possibly unprinted regions 221, 222, 223.

In an exemplary embodiment, in addition to at least one radiation source 201, 202, 203, the fixer 170 includes a ventilator configured to produce additional air flow for controlled adjustment of the evaporation rate of fluids of the applied one or more color components.

In an exemplary embodiment, a radiation source 201, 202, 203 includes a laser, wherein the beam of the laser may be deflected with a mirror wheel scanner over the entire print width of the printer 100 and/or over the entire width of the recording medium 120 in order to scan a print image or the recording medium 120 line by line. In an exemplary embodiment, fixing data 200 is provided by controller 101 to control the individual radiation sources 201, 202, 203. The fixing data 200 may thereby depend on the print data of the printed print image. The fixing data 200 may indicate the wavelength or the spectrum and/or the intensity or the energy of the radiation 211, 212, 213 (possibly per dot or per partial region 221, 222, 223). The print data may be provided by a raster graphics processor of the printer 100.

In an exemplary embodiment, a segmented arrangement with multiple radiation sources 201, 202, 203 arranged transversal to the transport direction 1 may be used, depending on the print width or the width of the recording medium 120, and depending on the print speed.

FIG. 3 shows absorption spectra 301, 302, 303, 304 of different color components (black, yellow, magenta, and cyan) in the visible range of 400 nm to 1400 nm according to an exemplary embodiment. In an exemplary embodiment, the wavelength range that is accounted for by a radiation source 201, 202, 203 is limited to the aforementioned wavelength range since shorter wavelengths, meaning ultraviolet radiation, may damage pigments due to the high photon energies, and since (with the exception of black) the radiation 211, 212, 213 is nearly exclusively absorbed by the recording medium 120 at longer wavelengths. In the wavelength range depicted in FIG. 3, there is no single wavelength at which more than 80% of the radiation 211, 212, 213 is absorbed in the ink layer or toner layer for all color components. However, if two suitable wavelengths are used in combination (for example 560 nm for cyan and magenta, and 458 nm for yellow and black), the absorption for all color components may be increased to over 95%, as shown in Table 1.

TABLE 1

| Color | First wavelength: 560 nm Absorption in color layer [%] | Second wavelength 2: 458 nm Absorption in color layer [%] |
|---|---|---|
| Yellow | 4.7 | 95.2 |
| Cyan | 95.4 | 34.1 |
| Magenta | 95.2 | 74.8 |
| Black | 95.9 | 96.0 |
| Radiation source | Dye laser | Argon ion laser |

The radiation relaxation may be taken into account depending on the pigment used in a color component. In other words, what fraction of the radiation that is absorbed by the color component relaxes without radiation, and therefore contributes to a temperature increase, may be taken into account. On the other hand, the fraction of the absorbed radiation 211, 212, 213 that leads to a radiation of the color component may remain unconsidered. The quality of the fixing may thus be further increased.

The fixing of a color layer may take place jointly in a single fixer 170 following the application of a plurality of color layers or color components. Alternatively or additionally, the corresponding color component may be fixed or intermediately fixed with a suitable wavelength or with a suitable spectrum directly after each color application.

FIG. 4*a* shows a recording medium 120 after application of a print image 400 according to an exemplary embodiment. The print image 400 may thereby have one or more different color components. The recording medium 120 (with the print image 400) has a thickness 401 orthogonal to the surface of the recording medium 120. However, within the scope of the fixing of the print image 400, a deformation of the recording medium 120 orthogonal to the surface of the recording medium 120 may occur so that the recording medium 120 has a maximum propagation 402 orthogonal to the surface of the recording medium 120 that may be significantly greater than the thickness 401 of said recording medium 120. If a recording medium 120 that is deformed in such a manner is introduced into a duplex print group of a printer 100 in order to apply an additional print image onto the back side of the recording medium 120, distortions of the print image occur, in particular in an inkjet printer 100. Furthermore, the relatively high maximum propagation 402 of the recording medium 120 may lead to the situation that the recording medium 120 contacts the nozzle plate of a print head 103 and thereby damages it.

In an exemplary embodiment, in order to enable a qualitatively high-grade and reliable duplex printing, the controller 101 of the fixer 170 for fixing of the print image 400 on the front side of the recording medium 120 is configured to adjust the radiation 211, 212, 213 of the one or more radiation sources 201, 202, 203 such that the deformation of the recording medium 120 orthogonal to the surface of the recording medium 120 is reduced, in particular is minimized, for example in a region-selective or dot-selective manner. For example, the maximum extent 402 of the recording medium 120 may thereby be reduced, in particular minimized.

For this purpose, in an exemplary embodiment, the controller 101 may access a deformation model 410 of the recording medium 120 (which is possibly printed to with the print image 400) (see FIG. 4*b*). Different deformation models 410 may be provided for different types of recording media 120. The deformation model 410 for a specific type of recording medium 120 may thereby be determined within the scope of measurements and/or simulations. The deformation model 410 may, for example, comprise a finite element model of a recording medium 120. The recording medium 120 may thereby be described by a plurality of finite elements (FE) that mutually influence one another. Alternatively or additionally, the deformation model 410 may encompass characteristic diagrams that indicate a deformation of the recording medium 120 as a result of the application of the print image 400 and/or as a result of the exposure of the recording medium 120.

Moisture is typically introduced into the recording medium 120 via the application of a print image 400. The introduction of moisture is thereby typically region-dependent or dot-dependent. This applies in particular to an ink-based print image 400. Moisture is typically drawn from the recording medium 120 via the exposure of the recording medium 120 within the scope of fixing. A region-selective or dot-selective removal of moisture may thereby be produced via a region-selective or dot-selective exposure. A region-dependent or dot-dependent distribution of the moisture along the surface of the recording medium 120, as well as a (total) deformation or warping of the recording medium 120 resulting from this, may thus be produced via the application of a print image 400 and via the exposure of the recording medium 120 within the scope of the fixing.

In an exemplary embodiment, the deformation model 410 describes or indicates how the recording medium 120 deforms in total as a result of the moisture that is applied with the print image 400 and is at least partially removed again via the exposure (in particular how it deforms in a direction orthogonal to the surface of the recording medium 120). The deformation model 410 may in particular indicate how the radiation 211, 212, 213 produced by the one or more radiation sources 201, 202, 203 affects the (total) deformation or warping of the recording medium 120 (that has been printed to with the print image 400). Print image data 411 for the print image 400 may be provided as input variables of the deformation model 410. The print image data 411 thereby indicate (if applicable for every single dot):

- the type of applied color component (for example ink or toner);
- the quantity of applied color component;
- the color, in particular the absorption spectrum 301, 302, 303, 304 of the color component; and/or
- the type and quantity of a coating substance.

In an exemplary embodiment, the controller 101 is configured to determine fixing data 200 for controlling the fixer 170 based on: the deformation model 410 of the recording medium 120, and/or the print image data 411. The fixing data 200 indicate (if applicable for every single dot):

- the spectrum and/or the wavelength or frequency of the radiation 211, 212, 213; and/or
- the intensity of the radiation 211, 212, 213.

In an exemplary embodiment, the fixing data 200 for controlling the one or more radiation sources 201, 202, 203 is thereby determined such that the (total) deformation or warping of the recording medium 120 orthogonal to the surface of the recording medium 120 is reduced, in particular is minimized. For example, this may take place within the scope of an FE simulation. For example, the FE model of the recording medium 120 may be used to determine the fixing data 200 for fixing of a print image 400 such that (for example in an iterative optimization process) the maximum extent 402 of the recording medium 120 (after application of the print image 400 and after fixing of said print image 400) is reduced, in particular is minimized. A defined fixing quality of the print image 400 may thereby be taken into account as a secondary condition.

FIG. 4*c* illustrates an FE-based deformation model 410 of a recording medium 120 according to an exemplary embodiment. The surface of the recording medium 120 may be subdivided along the two axes 422, 423 into a plurality of finite elements 421. On the basis of the print image data, the deformation model 410 may be expanded by finite elements 421 that describe the print image 400 on the surface of the recording medium 120. A finite element 421 may, for example, describe which stresses and/or forces are produced by the finite element 421 on one or more adjacent finite elements 421 if radiation 211, 212, 213 acts on said finite element 421. The warping of a recording medium 120 that has been printed to, as a result of an exposure, may thus be precisely and reliably simulated. In particular, properties of the radiation 211, 212, 213 may be varied, meaning that different fixing data 200 may be used, and the respective effects on the warping of the recording medium 120 may be simulated on the basis of the deformation model 410.

In an exemplary embodiment, in an iterative optimization process, the spectrum or the frequency and/or the intensity of the radiation 211, 212, 213 for the fixing is calculated based on the (possible FE-based) deformation model 410, via which an optimization criterion that is dependent on the (total) deformation of the recording medium 120 is reduced, in particular is minimized.

FIG. 5 shows a workflow diagram of a method 500 for fixing a print image 400 on a recording medium 120 according to an exemplary embodiment. In an exemplary embodiment, the method 500 is executed by controller 101 of fixer 170 of printer 100. The print image 400 may have been applied or may be applied by one or more dot generators of the printer 100 on a surface of the recording medium 120. The dot generator may in particular be the nozzles 21, 22 of one or more print heads 103. The print image 400 may thus be an ink-based print image.

In an exemplary embodiment, the method 500 includes the determination 501 of print image data with regard to the print image 400. The print image data may indicate print data for the one or more dot generators of the printer 100 for a partial region 221, 222, 223 of the surface of the recording medium 120, in particular for a (for example for every single) dot of the print image 400, with which printer 100 the print image 400 has been or is printed. Alternatively or additionally, for a partial region 221, 222, 223 of the surface of the recording medium 120, in particular for a (for example for every single) dot of the print image 400, the print image data may indicate: the type of a color component (for example of an ink) of the print image 400 that should be fixed; the quantity of the color component that should be fixed (for example the droplet size of a droplet that has been applied for a dot on the recording medium 120); and/or the absorption spectrum 301, 302, 303, 304 of the color component. Alternatively or additionally, for a partial region 221, 222, 223 of the surface of the recording medium 120, in particular for a (for example for every single) dot of the print image 400, the print image data may indicate: the type and/or the quantity of a coating substance (for example of a primer) that has been applied onto the recording medium 120 before printing the print image 400 on the recording medium 120.

The print image data may thus describe which components, in particular which fluids and/or color pigments, have been or are applied onto the recording medium 120 at which point within the scope of the printing of the print image 400. The print image data may thereby be provided for different partial regions 221, 222, 223, in particular for every single dot of the print image 400.

In an exemplary embodiment, the method 500 also includes the determination 502 of a deformation model 410 for the (printed) recording medium 120 on the basis of the print image data. A base model for the recording medium 120 may be provided to determine the deformation model 410. This base model is typically dependent on the type (for example on the material and/or on the treatment of the surface) of the recording medium 120. This base model may then be supplemented, on the basis of or under consideration of the print image data, by the components that have been applied on the recording medium 120 within the scope of printing of the print image 400. A deformation model 410 may thus be provided that takes into account both the recording medium 120 itself and the applied print image 400.

In an exemplary embodiment, the deformation model 410 indicates how the recording medium 120 printed to with the print image 400 is (possibly further) deformed or warped by the action of radiation 211, 212, 213 for fixing of the print image 400, in particular by radiation in a wavelength range between 400 nm and 1400 nm. The deformation model 410 may thereby describe the deformation or warping of the recording medium 120 in the direction orthogonal to the surface of the recording medium 120. For example, the deformation model 410 may indicate what additional deformation or warping of the recording medium 120 (which has been printed to with the print image 400) is produced by radiation 211, 212, 213 having a specific spectrum or frequency and/or having a specific intensity. The produced deformation or warping may be indicated for different spectra or frequencies and/or intensities and/or different spatial distributions of the radiation 211, 212, 213 on the surface of the recording medium 120.

A base warping of the recording medium 120 may be produced via the introduction of fluid upon application of the print image 400. An additional warping of the recording medium 120 (which is possibly directed counter to the base warping) may then be produced by the exposure, within the scope of the fixing, of the recording medium 120 printed to with the print image 400. A total warping or total deformation of the recording medium 120 results due to the superposition of the base warping and the additional warping. The deformation model 410 may indicate the total warping or total deformation of the recording medium 120 for different spectra or frequencies and/or intensities and/or different spatial distributions of the radiation 211, 212, 213 on the surface of the recording medium 120.

In an exemplary embodiment, the method 500 determines, under consideration of the deformation model 410, fixing data 200 for controlling the one or more radiation sources 201, 202, 203, via which fixing data 200 the total warping or total deformation of the recording medium 120 is reduced, in particular is minimized.

In an exemplary embodiment, the deformation model 410 is dependent on the type of recording medium. In particular, the deformation model 410 is typically dependent on the absorption capability of the recording medium for the color component and/or for the coating substance. Furthermore, the deformation model 410 is typically dependent on the rigidity and/or the elasticity of the recording medium. The deformation model 410 may thereby be based on measurements of the deformation of a recording medium 120 of the same type, in particular as a result of the application of a print image 400 and/or as a result of the action of radiation 211, 212, 213. In particular, parameter values of parameters of the deformation model 410 may be determined on the basis of measurements. Furthermore, the deformation model 410 is typically dependent on the print image data.

In an exemplary embodiment, the deformation model 410 includes a finite element model of the recording medium 120 and/or of the print image 400, wherein the finite element model has a plurality of elements 421. Every individual element 421 may be described by a plurality of parameters. Different elements 421 may thereby be provided for the recording medium 120 and for the print image 400. How the element 421 behaves mechanically (for example expands and/or compacts) in reaction to the effect of radiation 211, 212, 213 may be described by the parameter of an element 421. In particular, the finite element model may indicate or describe which stresses and/or forces are produced by one element 421 on another element 421 of the plurality of elements 421 as a result of the effect of radiation 211, 212, 213. The (possibly additional) warping of the recording medium 120 as a result of the effect of radiation 211, 212, 213 in the fixing of the print image 400 may then be simulated on the basis of the mechanical variations and interactions of the individual elements 421 of the finite element model. The use of a finite element model thus enables a precise determination of the (possibly additional) deformation or warping of a recording medium 120 within the fixer 170.

In an exemplary embodiment, the method 500 also includes the determination 503, on the basis of the deformation model 410, of fixing data 200 for controlling the one or more radiation sources 201, 202, 203 of the fixer 170. The fixing data 200 for a partial region 221, 222, 223 of the surface of the recording medium 120, in particular for a dot (for example for each dot) of the print image 400, may thereby indicate: the spectrum and/or at least one frequency of the radiation 211, 212, 213 for fixing and/or the intensity of the radiation 211, 212, 213 for fixing. With which spectrum, or with which frequency, and/or with which intensity of radiation 211, 212, 213 different partial regions 221, 222, 223 and/or different dots on the recording medium 120 are to be exposed, on the one hand in order to produce a sufficient fixing and on the other hand to produce an optimally small (total) deformation or warping of the recording medium 120, may thus be determined on the basis of the deformation model 410. In particular, the fixing data 200 may be determined such that a base warping of the recording medium 120 due to the application of the print image 400 is canceled again as optimally comprehensively as possible via the (dot-dependent) exposure of the surface of the recording medium 120, such that an optimally small (total) deformation or warping of the recording medium 120 remains.

In an exemplary embodiment, the fixing data 200 is determined both for a printed partial region 221, 222 and for an unprinted partial region 223 of the surface of the recording medium 120. In other words: within the scope of the fixing, radiation 211, 212, 213 may act both on a printed partial region 221, 222 and on an unprinted partial region 223 of the surface of the recording medium 120. If applicable, the exposure of an unprinted partial region 223 may thereby be used to reduce the (total) deformation or warping of the recording medium 120. For example, forces and/or stresses on an adjacent partial region 221, 222 may be produced by the exposure of an unprinted partial region 223 so that the (total) deformation or warping of the recording medium 120 is reduced.

In an exemplary embodiment, the fixing data 200 is determined depending on the deformation model 410 such that an optimization criterion is reduced, in particular is optimized. In particular, the fixing data 200 may be determined by means of an iterative optimization method, for example a gradient method, for optimization of the optimization criterion. Within the scope of the optimization method, a respective value of the optimization criterion may thereby be determined on the basis of the deformation model 410 for different fixing data 200. The fixing data 200 may then be selected that produce as optimal a value of the optimization criterion as possible. Deformations of the recording medium 120 may thus be reliably reduced (given sufficiently high fixing quality).

The optimization criterion may depend on the (total) deformation or warping of the recording medium 120 orthogonal to the surface of the recording medium 120 (as a result of the application of the print image 400 and as a result of the effect of the radiation 211, 212, 213 to fix the print image 400). For example, the optimization criterion may depend on the maximum extent 402 of the recording medium 120 after conclusion of the fixing. The (total) deformation or warping of the recording medium 120 may be reduced, in particular minimized within the scope of the optimization.

In an exemplary embodiment, alternatively or additionally, the optimization criterion may depend on a temperature gradient within the surface of the recording medium 120 (as a result of the effect of the radiation 211, 212, 213 for fixing of the print image 400). An optimally uniform temperature distribution, or an optimally small temperature gradient, may thereby be produced within the scope of the optimization. Alternatively or additionally, the optimization criterion may depend on a moisture gradient within the surface of the recording medium 120 (as a result of the application of the print image 400 and as a result of the effect of the radiation 211, 212, 213 for fixing of the print image 400). An optimally uniform moisture distribution, or an optimally small moisture gradient, may thereby be produced within the scope of the optimization.

Moreover, the quality of the fixing of the print image 400 may be taken into account within the scope of the optimization. A specific minimum quality of the fixing that is to be achieved may thereby be taken into account in the optimization as a secondary condition. It may thus be achieved that, given a sufficiently high fixing quality, the (total) deformation of the recording medium 120 is reduced, in particular is minimized, following the fixing.

Moreover, in an exemplary embodiment, the method 500 includes the operation 504 of the one or more radiation sources 201, 202, 203 depending on the fixing data 200 in order to at least partially fix the print image 400 on the recording medium 120. The (partial) fixing of the print image 400 may thus be produced using the radiation 211, 212, 213 of one or more radiation sources 201, 202, 203. The radiation 211, 212, 213 is thereby spatially varied (for example in a partial region-selective or dot-selective manner) such that the (total) deformation or warping of the recording medium 120 is reduced, in particular is minimized, after implementing the fixing.

A method 500 for fixing a print image 400 on a recording medium 120 is thus described in which fixing data 200 for controlling one or more radiation sources 201, 202, 203 for fixing the print image 400 are determined by means of a deformation model 410 of the recording medium 120 such that the (total) deformation or warping of the recording medium 120 is minimized after implementation of the exposure.

Furthermore, described in this document is a fixer 170 for fixing a print image 400 on a recording medium 120. The fixer 170 comprises one or more radiation sources 201, 202, 203 that are configured to generate radiation 211, 212, 213 for fixing of the print image 400. The radiation sources 201, 202, 203 may be configured to generate radiation 211, 212, 213 with a spectrum or with one or more frequencies from the wavelength range between 400 nm and 1400 nm. The different radiation sources 201, 202, 203 thereby typically have different spectra or different wavelengths. For example, a first radiation source 201 may generate radiation 211 with a first wavelength of 560 nm, and a second radiation source 202 may generate radiation 212 with a second wavelength of 458 nm.

The print image 400 may comprise at least two different color components, wherein the different color components have different absorption spectra 301, 302, 303, 304. The spectra of the radiation 211, 212, 213 of the radiation sources 201, 202, 203 may then preferably be adapted to the absorption spectra 301, 302, 303, 304 of the color components, such that up to 90%, 95%, or more of the radiation 211, 212, 213 of at least one radiation source is absorbed by the color component for each color component of the print image 400. For example, given typical color components (such as cyan, yellow, magenta, and/or black), this may be achieved via the aforementioned first and second wavelength.

The fixer 170 also comprises a controller 101 that is configured to determine print image data with regard to the print image 400 that has been or is printed on a surface of the recording medium 120. Moreover, the controller 101 is configured to determine a deformation model 410 for the recording medium 120 (which is printed to with the print image 400) on the basis of the print image data. The deformation model 410 may thereby indicate how the recording medium 120 printed to with the print image 400 is deformed or warped (in total) via the effect of radiation 211, 212, 213 to fix the print image.

The controller 101 may then determine fixing data 200 to control the one or more radiation sources 201, 202, 203 on the basis of the deformation model 410. The fixing data 200 may thereby be determined such that an optimization criterion is optimized with regard to the (total) deformation or warping of the recording medium 120 (for example such that the maximum extent 402 of the recording medium 120 is minimized). The one or more radiation sources 201, 202, 203 may then be operated depending on the fixing data 200 in order to fix the print image 400 at least partially on the recording medium 120. The generated radiation 211, 212, 213 may thereby be adapted per partial region or per dot, for example.

Within the scope of a printing process, a sequence of print images 400 is typically printed on a recording medium 120 (in the form of a band, for example). The optimized fixing data 200 may be determined for each print image 400 of the sequence of print images 400. The determination may thereby take place online and/or in real time during a printing process. This is advantageous since, for example, additional sensor data of a sensor 150 may be taken into account in the determination of the fixing data 200 in order to further reduce the dimension of the deformation of a recording medium 120. For example, the sensor data may indicate a dimension of the (total) deformation or warping of the recording medium 120 at the output of the fixer 170. These sensor data may then be taken into account in the determination of the fixing data 200, for example within the scope of a feedback loop, in order to determine optimized fixing data 200. For example, the deformation model 410 of the recording medium 120 may be adapted on the basis of the sensor data.

The optimized fixing data 200 may alternatively be determined in advance. The requirements for computing resources of a controller 101 for the fixer 170 may thus be reduced.

Via the measures described in the present disclosure, an amount the recording medium 120 is modified is reduced (e.g. minimized) within the scope of the fixing process, and/or thermal and/or moisture-dependent stress is reduced (e.g. minimized). An extent of (total) deformation of the recording medium 120 may thus be minimized. Furthermore, a color-dependent fixing quality may be produced. Moreover, the energy cost for radiative fixing may be minimized since the radiation energy is primarily introduced into a color layer or color component. Via the use of multiple radiation sources 201, 202, 203, it may also be achieved that multiple color layers or color components may be fixed with a single exposure process after the print image application. An intermediate fixing between the applications of the individual print colors is thus not necessary, rather only a common radiative fixing after application of all colors.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle (ink)
31, 32 column (of the print image)
41, 42 nozzle (coating substance)
51, 52 column (of the coating image)
100 printer
101 controller
102 print bar
103 print head (ink)
120 recording medium
140 print group
142 coater
143 print head (coating substance)
150 sensor
170 fixer
200 fixing data
201, 202, 203 radiation source
211, 212, 213 radiation
221, 222 partial region of a print image
223 unprinted partial region of a recording medium
301-305 absorption spectrum
400 print image
401 thickness (recording medium)
402 maximum extent
410 deformation model
411 print image data
421 finite element
422, 423 axes of the surface of a recording medium
500 method for fixing a print image
501-504 method steps

The invention claimed is:

1. A method for fixing a print image on a recording medium, comprising:

determining print image data of the print image that is or has been printed on a surface of the recording medium;

determining, based on the print image data, a deformation model for the recording medium that indicates a deformation of the recording medium having the print image printed thereon and after an effect of radiation to fix the print image for different spectra, intensities, and/or spatial distributions of the radiation, the deformation being orthogonal to the surface of the recording medium;

determining, based on the deformation model, fixing data, such that an optimization criterion is optimized, to control one or more radiation sources that are configured to generate the radiation to fix the print image; and operating the one or more radiation sources based on the fixing data to fix the print image at least partially on the recording medium, wherein the optimization criterion depends on:

the deformation of the recording medium having the print image printed and fixed thereon;

a temperature gradient within the surface of the recording medium having the print image printed thereon following the effect of the radiation for fixing of the print image; and/or a moisture gradient within the surface of the recording medium having the print image printed thereon following the effect of the radiation for fixing of the print image.

2. The method according to claim 1, wherein:

the fixing data is determined using an iterative optimization method for optimization of the optimization criterion; and the optimization method includes determining a respective value of the optimization criterion for different fixing data based on the deformation model.

3. The method according to claim 1, wherein the deformation model:

is dependent on a type of the recording medium; and/or is based on measurements of the deformation of a recording medium of the same type as the recording medium; and/or depends on the print image data.

4. The method according to claim 1, wherein:

the deformation model comprises a finite element model of the recording medium and/or of the print image;

the finite element model comprises a plurality of elements; and the finite element model indicates which stresses and/or forces are produced by one element of the plurality of elements on another element of the plurality of elements in particular as a result of the effect of radiation.

5. The method according to claim 1, wherein the fixing data is determined both for a printed partial region of the surface of the recording medium and for an unprinted partial region of the surface of the recording medium.

6. The method according to claim 1, wherein the fixing data for a partial region of the surface of the recording medium for one or more dots of the print image defines:

a spectrum and/or at least one frequency of the radiation generated by the one or more radiation sources for fixing; and/or an intensity of the radiation generated by the one or more radiation sources for fixing.

7. The method according to claim 1, wherein the print image data for a partial region of the surface of the recording medium for one or more dots of the print image includes:

print data for a dot generator of the printer configured to generate the one or more dots of the print image;

a type of a color component of the print image to be fixed;

a quantity of the color component to be fixed;

an absorption spectrum of the color component; and/or a type and/or a quantity of a coating substance applied on the recording medium before printing of the print image.

8. A fixer for fixing the print image on the recording medium, the fixer comprising the one or more radiation sources, and a controller that is configured to perform the method of claim 1.

9. A non-transitory computer-readable storage medium with an executable program stored thereon, wherein, when executed, the program instructs a processor to perform the method of claim 1.

10. A fixer for fixing a print image on a recording medium, the fixer comprising:

at least two radiation sources configured to generate radiation, having different spectra and/or different frequencies, to fix the print image, wherein the print image includes at least two different color components having different absorption spectra; and a controller configured to:

determine print image data of the print image that is or has been printed on a surface of the recording medium;

determine a deformation model for the recording medium based on the print image data, the deformation model indicating a deformation of the recording medium having the print image printed thereon and after an effect of radiation to fix the print image on the recoding medium for different spectra, intensities, and/or spatial distributions of the radiation;

determine, based on the deformation model, fixing data to control the at least two radiation sources; and control the at least two radiation sources based on the fixing data to at least partially fix the print image on the recording medium, wherein the spectra and/or the frequencies of the radiation of the at least two radiation sources are adapted to the absorption spectra of the color components such that, for each color component of the print image, at least 90% of the radiation of at least one of the at least two radiation sources is absorbed by the color component.

11. The fixer according to claim 10, wherein the deformation of the recording medium is orthogonal to the surface of the recording medium.

12. A method for fixing a print image on a recording medium, comprising:

determining print image data of the print image that is or has been printed on a surface of the recording medium, wherein the print image data for a partial region of the surface of the recording medium for one or more dots of the print image includes: print data for a dot generator of the printer configured to generate the one or more dots of the print image, a type of a color component of the print image to be fixed, a quantity of the color component to be fixed, an absorption spectrum of the color component, and/or a type and/or a quantity of a coating substance applied on the recording medium before printing of the print image;

determining, based on the print image data, a deformation model for the recording medium that indicates a deformation of the recording medium having the print image printed thereon and after an effect of radiation to fix the print image for different spectra, intensities, and/or spatial distributions of the radiation;

determining, based on the deformation model, fixing data to control one or more radiation sources that are configured to generate the radiation to fix the print image; and operating the one or more radiation sources based on the fixing data to fix the print image at least partially on the recording medium.

* * * * *